US009849468B2

(12) United States Patent
Robertson

(10) Patent No.: US 9,849,468 B2
(45) Date of Patent: Dec. 26, 2017

(54) CYCLONIC SEPARATOR HAVING STACKED CYCLONES

(71) Applicant: Dyson Technology Limited, Wiltshire (GB)

(72) Inventor: James Stuart Robertson, Bath (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 503 days.

(21) Appl. No.: 14/520,713

(22) Filed: Oct. 22, 2014

(65) Prior Publication Data

US 2015/0113762 A1 Apr. 30, 2015

(30) Foreign Application Priority Data

Oct. 24, 2013 (GB) ..... 1318815.6

(51) Int. Cl.
*A47L 9/16* (2006.01)
*B04C 3/04* (2006.01)

(52) U.S. Cl.
CPC ..... *B04C 3/04* (2013.01); *A47L 9/165* (2013.01); *A47L 9/1616* (2013.01); *A47L 9/1625* (2013.01); *A47L 9/1633* (2013.01); *A47L 9/1641* (2013.01)

(58) Field of Classification Search
CPC .... A47L 9/1616; A47L 9/1625; A47L 9/1641; A47L 9/1633; B04C 3/04
See application file for complete search history.

(56) References Cited

U.S. PATENT DOCUMENTS

| | | | | |
|---|---|---|---|---|
| 3,425,192 | A | 2/1969 | Davis | |
| 4,373,228 | A | 2/1983 | Dyson | |
| 6,607,572 | B2 | 8/2003 | Gammack et al. | |
| 2006/0123590 | A1 | 6/2006 | Fester et al. | |
| 2012/0272474 | A1 | 11/2012 | Follows et al. | |
| 2013/0160232 | A1 * | 6/2013 | Peace | A47L 9/165 15/353 |

FOREIGN PATENT DOCUMENTS

| | | |
|---|---|---|
| EP | 0 042 473 | 12/1981 |
| EP | 1 268 076 | 1/2003 |
| EP | 1 721 652 | 11/2006 |
| EP | 1 837 079 | 9/2007 |
| FR | 2.078.957 | 11/1971 |

(Continued)

OTHER PUBLICATIONS

International Search Report and Written Opinion dated Feb. 3, 2015, directed to International Application No. PCT/GB2014/053000; 9 pages.

(Continued)

*Primary Examiner* — Laura C Guidotti
(74) *Attorney, Agent, or Firm* — Morrison & Foerster LLP

(57) ABSTRACT

A cyclonic separator having a first cyclone stage; and a second cyclone stage comprising a plurality of cyclone bodies arranged in parallel, each cyclone body comprising an inlet and an outlet, the plurality of cyclone bodies being divided into at least a first layer and a second layer; wherein the second cyclone stage further comprises a first plenum common to the cyclone bodies, the first plenum extending from the outlet of the first cyclone stage to the inlets of each of the cyclone bodies of the second cyclone stage.

15 Claims, 10 Drawing Sheets

(56) References Cited

FOREIGN PATENT DOCUMENTS

| | | |
|---|---|---|
| GB | 2 426 726 | 12/2006 |
| GB | 2 453 949 | 4/2009 |
| GB | 2 475 313 | 5/2011 |
| GB | 2490225 | 10/2012 |
| GB | 2492744 | 1/2013 |
| JP | 7-3270 | 1/1995 |
| JP | 2008-541815 | 11/2008 |
| WO | WO-01/74493 | 10/2001 |
| WO | WO-2006/125945 | 11/2006 |
| WO | WO-2012/140450 | 10/2012 |

OTHER PUBLICATIONS

Search Report dated Jan. 28, 2014, directed to GB Application No. 1318815.6; 1 page.

* cited by examiner

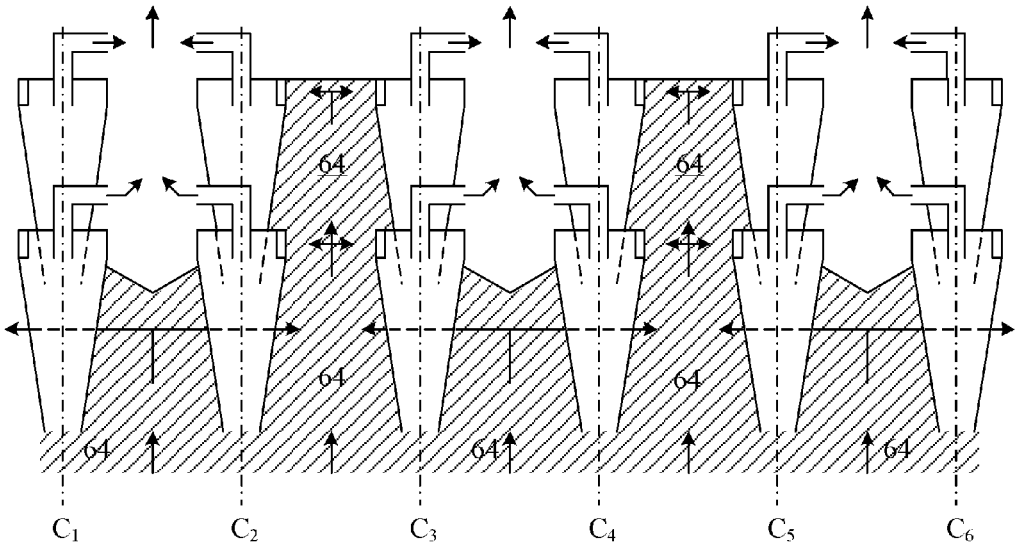
FIG 6a
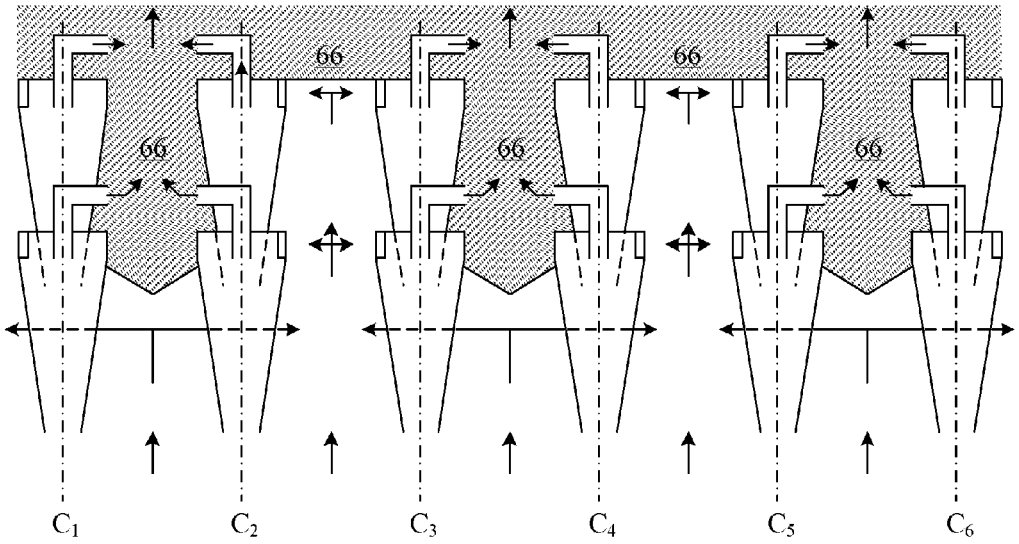
FIG 6b
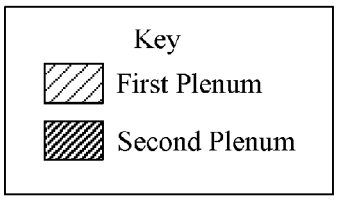

CYCLONIC SEPARATOR HAVING STACKED CYCLONES

REFERENCE TO RELATED APPLICATION

This application claims priority of United Kingdom Application No. 1318815.6 filed Oct. 24, 2013, the entire contents of which are incorporated herein by reference.

FIELD OF THE INVENTION

The present invention relates to a cyclonic separator having stacked cyclones.

BACKGROUND OF THE INVENTION

Vacuum cleaners which utilise cyclonic separators are well known. Cyclonic separators typically comprise a first cyclone stage and a second cyclone stage downstream of the first cyclone stage. The first cyclone stage, which is intended to remove larger dirt and debris, typically comprises a relatively large cyclone chamber, whereas the second cyclone stage, which is intended to remove finer dirt that is able to pass through the first cyclone stage, typically comprises a number of smaller cyclone bodies connected in parallel.

The smaller cyclone bodies are usually arranged in a ring around a longitudinal axis of the cyclonic separator. Through providing a plurality of relatively small cyclones in parallel instead of a single relatively large cyclone, the separation efficiency of the second cyclone stage (i.e. the ability to separate entrained particles from an air flow) can be increased. This is due to an increase in the centrifugal forces generated within the smaller cyclone bodies which cause dust particles to be thrown from the air flow.

Increasing the number of parallel cyclones can further increase the separation efficiency. However, when the cyclone bodies are arranged in a ring this can increase the external diameter of the cyclonic separator, which in turn can undesirably increase the size of the vacuum cleaner. While this size increase can be ameliorated through reducing the size of the individual cyclones, the extent to which the cyclone bodies can be reduced in size is limited. Very small cyclones can become rapidly blocked and can be detrimental to the rate of the air flow through the vacuum cleaner, and thus its cleaning efficiency.

In order to be able to increase the number of cyclone bodies in a cyclonic separator without increasing its external diameter, a recent trend has been to stack the cyclone bodies in two or more layers. Such a configuration is described in GB2475313.

Even when stacked in two or more layers, the cyclone bodies remain connected in parallel. In order that air reaches all layers of cyclones, a system of conduits, or ducts, is provided within the second cyclone stage. By way of example, FIG. 1 shows a schematic representation of stacked cyclone bodies 10 according to a known configuration which shows sets of conduits 16 and 18 that convey air to the cyclone bodies 10, and a further set of conduits 20 that convey air from the cyclone bodies 10. Two layers of cyclone bodies are provided, a lower layer L and an upper layer U, each cyclone body 10 comprising an inlet 12 and a vortex finder 14 that serves as an outlet. Sets of inlet conduits 16 and 18 are provided to convey air from the first cyclone stage to the cyclone bodies 10 of the second cyclone stage. One set of these inlet conduits 16 is configured to convey air to the cyclone bodies 10 on the lower layer L, and the other set of conduits 18 is configured to convey air to the cyclone bodies 10 on the upper layer U. The vortex finders 14 of each of the cyclone bodies 10 on both the upper and lower layers L, U then feed into one of a number of outlet conduits 20 which convey the cleaned air downstream to a next stage in the cyclonic separator.

As can be seen from FIG. 1, the fluid paths through the conduits are different. This can lead to uneven loading of the air supply on the cyclone bodies 10. For example, some cyclone bodies, through which an easier fluid path is available, will be under a greater load than other cyclone bodies that provide a more tortuous fluid path for the air to take. This creates inefficiency within the cyclonic separator, and can reduce the overall efficiency of the vacuum cleaner.

SUMMARY OF THE INVENTION

This invention provides a cyclonic separator comprising a first cyclone stage; and a second cyclone stage comprising a plurality of cyclone bodies arranged in parallel, each cyclone body comprising an inlet and an outlet, the plurality of cyclone bodies being divided into at least a first layer and a second layer; wherein the second cyclone stage further comprises a first plenum common to the cyclone bodies, the first plenum extending from the outlet of the first cyclone stage to the inlets of each of the cyclone bodies of the second cyclone stage.

As a result, air that enters the cyclone bodies is drawn from a single common volume, and so a more even loading of the air supply on the cyclone bodies can be achieved. If the cyclone bodies are loaded more evenly, this can help the cyclonic separator to separate dust and dirt from the air passing through it more efficiently, and may in turn result in a more efficient vacuum cleaner.

The second cyclone stage may further comprise a second plenum common to the cyclone bodies and extending from the outlet of each of the cyclone bodies. The second plenum makes it possible for all air leaving the cyclone bodies to be deposited into a single common volume, this in addition to the first plenum can go even further to achieve a more even loading of the air supply on the cyclone bodies, which can lead to a better separation efficiency and a more efficient vacuum cleaner.

The second plenum may substantially surround the first plenum. This allows the first plenum to extend to the inlets of the cyclone bodies in the second layer, while at the same time the second plenum can extend from the outlets of the cyclone bodies in the first layer. By having the second plenum substantially surround the first plenum, both plenums are able to be common to each of the cyclone bodies, and may help to prevent a need to increase the size of the cyclonic separator.

The cyclonic separator may comprise a further stage located downstream of the second cyclone stage, the second plenum may extend from the outlets of the cyclone bodies to the further stage, and the further stage may be one of a cyclone stage, a filter stage and a chamber comprising an outlet of the cyclonic separator. By having the second plenum extend from the outlets of the cyclone bodies to the further stage, the second plenum can take advantage of the maximum volume available to it which can go further to help even out the load of the air supply between the cyclone bodies.

The second and/or first plenum may be substantially annular. This can allow the plenum(s) to extend around to reach the whole ring of cyclone bodies, but at the same time also allows other components and stages within the cyclonic separator to be housed within the area surrounded by the plenum(s).

The inlet to the first plenum may be substantially annular. This allows air to be drawn into the first plenum from substantially the whole way around the inner circumference of the first cyclone stage. This can further aid to even the loading of the air supply on each of the cyclone bodies.

Each inlet may have the same size and dimensions as all the other inlets, and each outlet may have the same size and dimensions as all the other outlets. If all inlets to the cyclone bodies are the same size and have the same dimensions, this stops any uneven loading on the cyclone bodies due to differences in the inlets. The same applies to having all the outlets the same size and of the same dimensions to each other.

This invention further provides a cyclonic separator as herein described with reference to and as shown in the accompanying drawings.

This invention further provides a vacuum cleaner comprising a cyclonic separator as described in any one of the preceding statements.

BRIEF DESCRIPTION OF THE DRAWINGS

In order that the present invention may be more readily understood, embodiments of the invention will now be described, by way of example, with reference to the accompanying drawings, in which:

FIGS. 5, 6*a* and 6*b* are schematic representations of cyclone bodies in the cyclonic separator of FIG. 3;

DETAILED DESCRIPTION OF THE INVENTION

Figure 1:
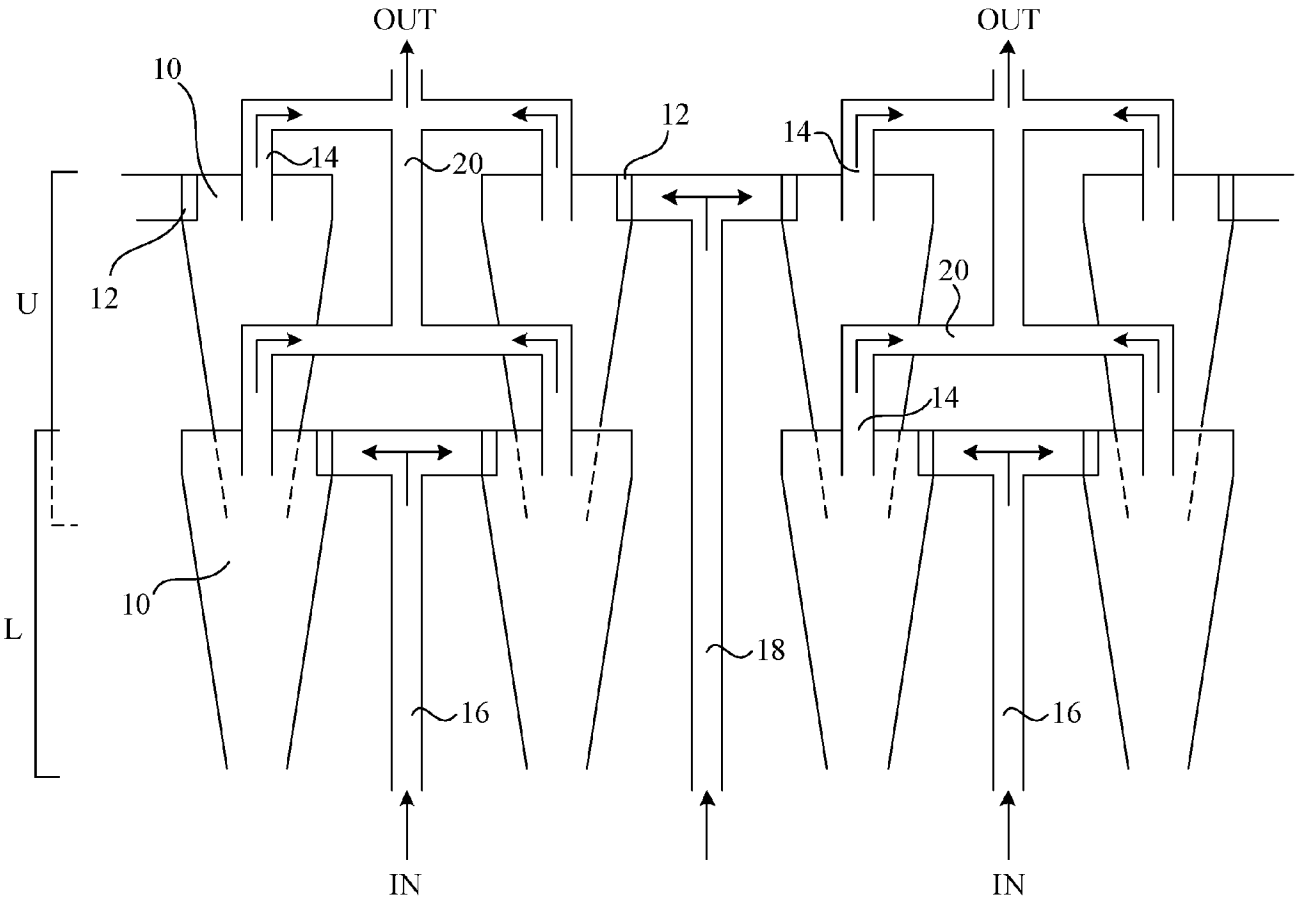
FIG 1 (PRIOR ART)
FIG. 1 is a schematic representation of a known configuration of stacked cyclone bodies in a cyclonic separator.
Figure 2:
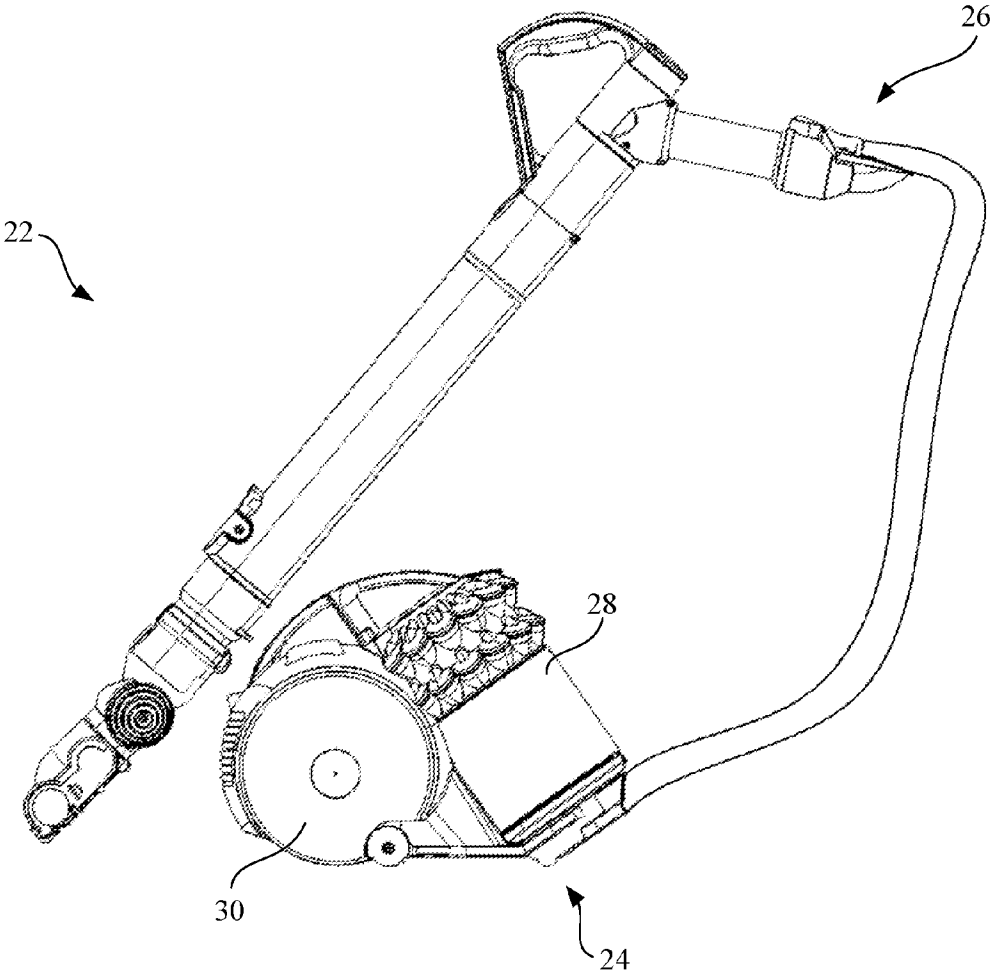
FIG. 2 is a cylinder vacuum cleaner.

FIG. 2 illustrates an external view of a cleaning appliance in the form of a vacuum cleaner 22. The vacuum cleaner 22 is of the cylinder or canister type which typically has a body 24 which is pulled behind a hose and wand assembly 26 during use. Although FIG. 2 shows a cylinder type vacuum cleaner, the presently claimed invention can be incorporated within any style of vacuum cleaner that comprises a cyclonic separator with stacked cyclones, other examples of which may be upright or handheld vacuum cleaners.

The body 24 comprises a cyclonic separator 28 for separating dirt and dust from an airflow, and a chassis 30. The cyclonic separator 28 is received within the chassis 30 such that it is at least partially nested or docked within the chassis 30. In use, a motor and fan unit located within the chassis 30 draws dust laden air into the vacuum cleaner 22. The dirty air enters the body 24 from the hose and wand assembly 26 via an inlet duct, and into the cyclonic separator 28. Dirt and dust particles entrained within the air flow are separated from the air and retained in the cyclonic separator 28. The clean air then passes from the cyclonic separator into the chassis 30 and is subsequently expelled through air outlets in the body 24. The cyclonic separator 28 is removable from the chassis 30 such that any dirt collected by the cyclonic separator 28 may be emptied.

Figure 3:
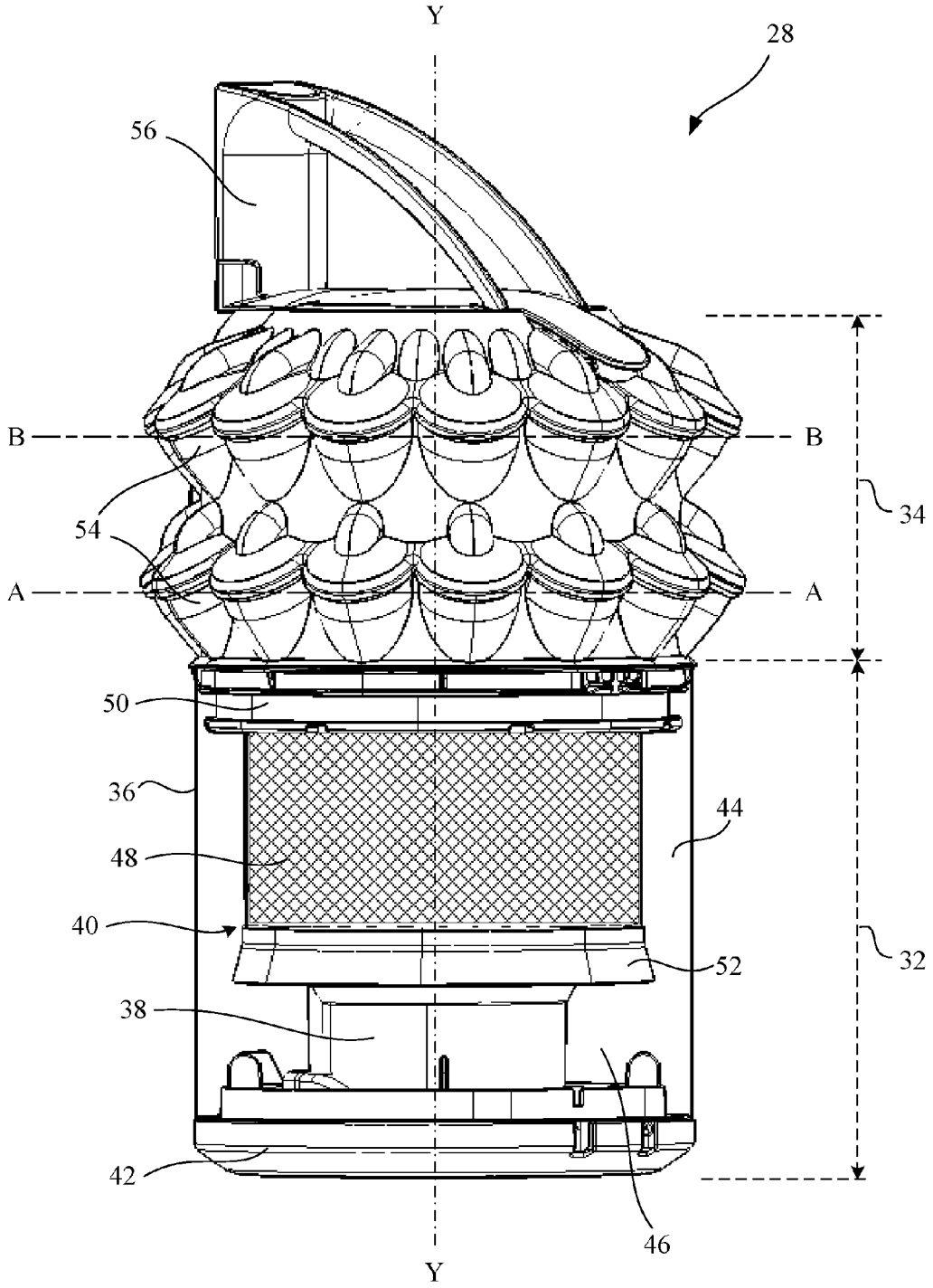
FIG. 3 is a cyclonic separator for a vacuum cleaner.

FIG. 3 shows the cyclonic separator 28. The cyclonic separator 28 comprises a first cyclone stage 32 and a second cyclone stage 34 located downstream of the first cyclone stage 32. The first cyclone stage 32 is intended to remove relatively large dirt and debris, and the second cyclone stage 34 is intended to remove finer dirt that is able to pass through the first cyclone stage 32. A handle 56 is provided at the top of the cyclonic separator 28 for carrying the cyclonic separator 28 and the body 24.

The first cyclone stage 32 comprises an outer wall 36, an inner wall 38, a shroud 40 and a base 42, which collectively define a cyclone chamber 44 and a first dirt collection chamber 46. An inlet (not shown) to the cyclone chamber 44 is provided and arranged so as to introduce air into the cyclone chamber 44 in a substantially tangential direction in order to encourage the air to flow in a spiral or helical manner around the cyclone chamber 44. The shroud 40 comprises a mesh 48 secured to an upper portion 50 and a lower portion 52. Partially cleaned air exits the cyclone chamber 44 through the mesh 48 and is then directed towards the second cyclone stage 34.

The second cyclone stage 34 comprises a second dirt collection chamber and a plurality of cyclone bodies 54 arranged in two layers about a longitudinal axis (shown as dotted line Y-Y in FIG. 3) of the cyclonic separator 28. The second cyclone stage 34 illustrated in the figures comprises two layers of cyclone bodies 54. However, other alternative embodiments may contain more than two stacked layers of cyclone bodies 54.

Although only a lower section of the inner wall 38 is visible in FIG. 3, it extends beneath the shroud 40 and joins to the base of the cyclone bodies 54 at the top of the first cyclone stage 32. The inner wall 38 defines an inner cavity that is the second dirt collection chamber. The finer dirt captured by the second cyclone stage 34 is collected in the second dirt collection chamber. Both the first and second dirt collection chambers are closed at the lower end by the base 42. The base 42 can be opened to allow both the first and second dirt collection chambers to be emptied. For example, the base 42 may be pivotably attached to the outer wall 36 by a hinge and can be held in a closed position by a catch which engages a lip located on the outer wall 36.

Figure 4:
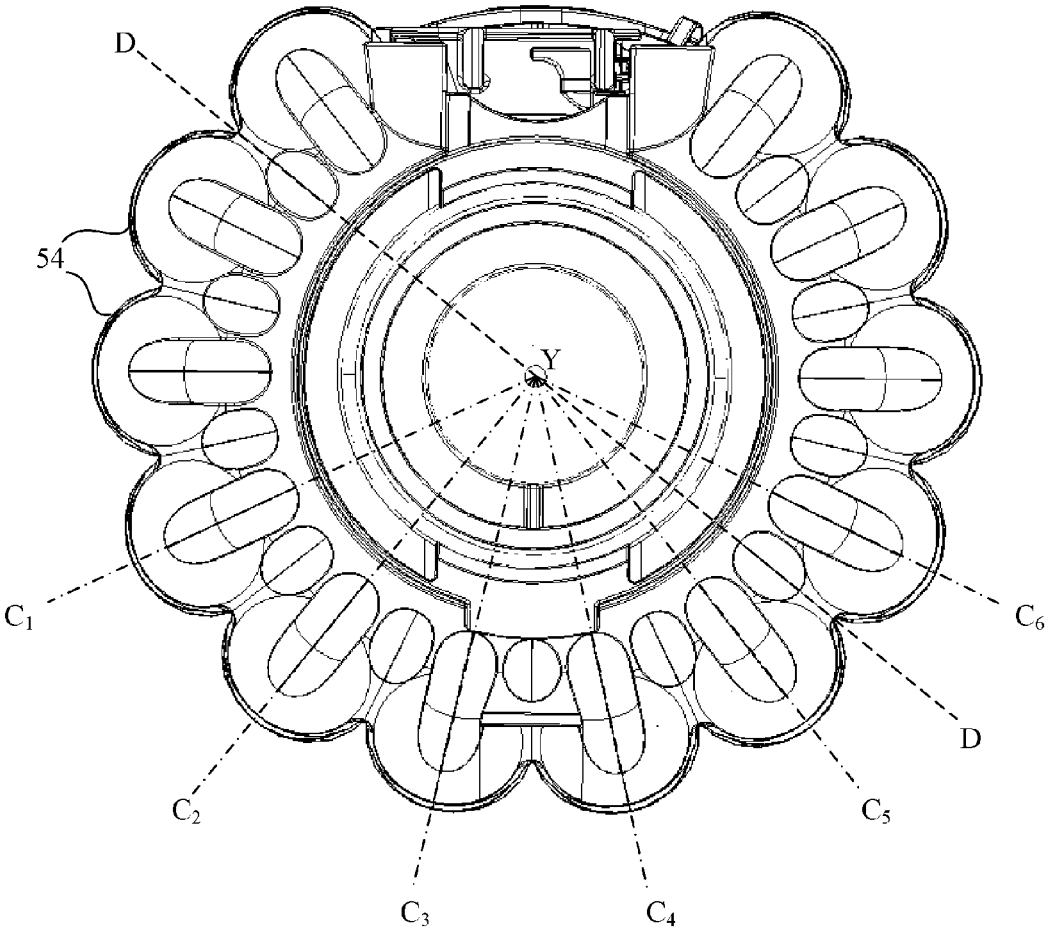
FIG. 4 is a plan view of the cyclonic separator of FIG. 3.

A plan view of the cyclonic separator 28 is shown in FIG. 4. The handle 56 has been omitted from FIG. 4 to show more clearly the arrangement of the cyclone bodies 54 in the second cyclone stage 34. The embodiment of the figures shows a cyclonic separator 28 that has two layers of cyclone bodies, each layer comprising twelve cyclone bodies. The cyclone bodies extend nearly the entire way around the Y-Y longitudinal axis. It will be understood that in alternative embodiments, the cyclone bodies may be arranged differently within the layers, for example they may extend fully around the Y-Y longitudinal axis. Furthermore, different numbers of cyclone bodies may also be provided within the layers of the second cyclone stage 34. The cyclone bodies 54 positioned in line with the dotted lines C1 to C6 are shown in the schematic representations of FIGS. 5, 6*a* and 6*b*.

Figure 5:
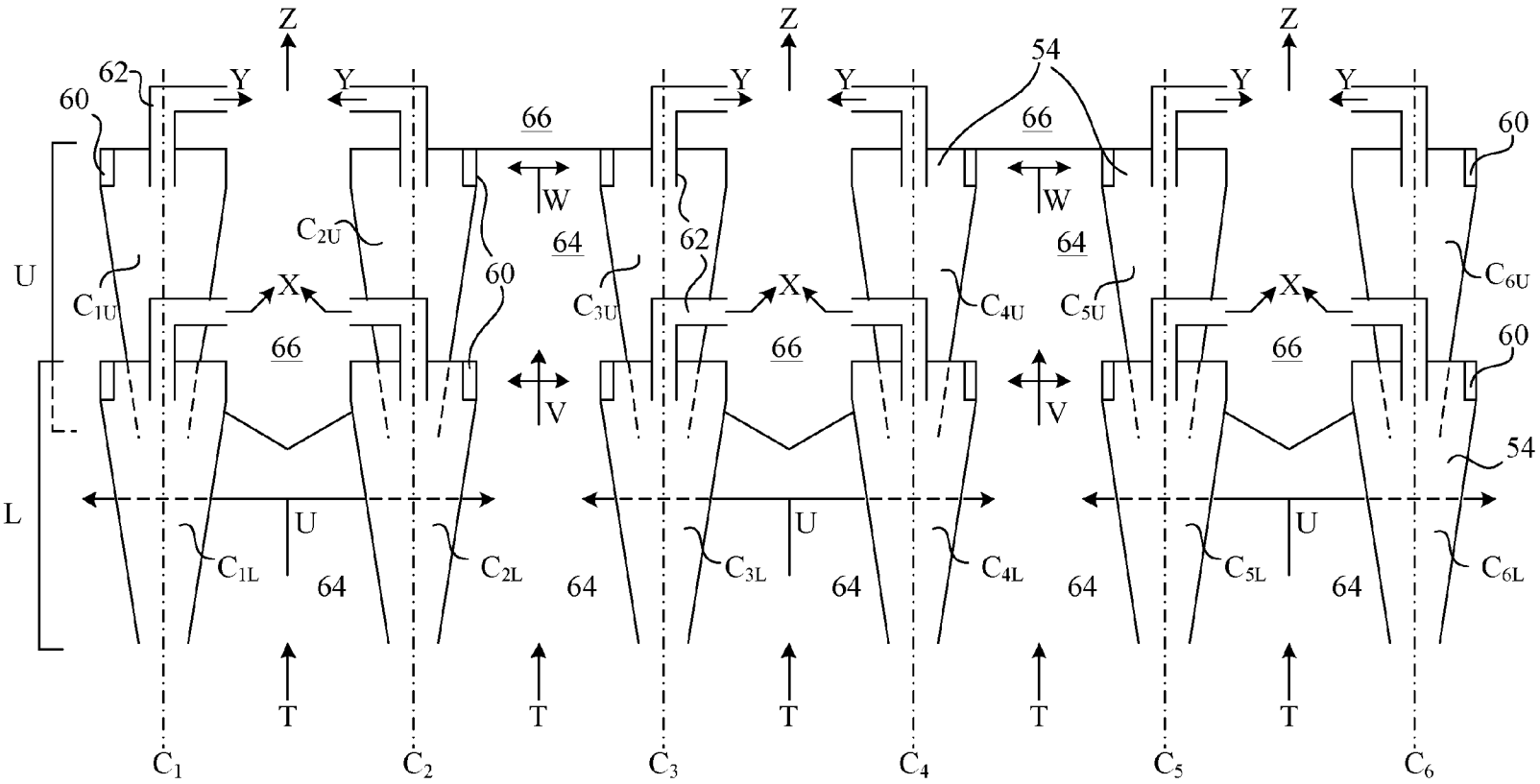

FIG. 5 shows twelve cyclone bodies 54. Each cyclone body 54 comprises an air inlet 60 and an air outlet in the form of a vortex finder 62. The bottom end of each cyclone body 54 is open and extends into the second dirt collection chamber (not shown) such that any dust and dirt separated from the air within the cyclone body can be deposited into the second dirt collection chamber. The second dirt collection chamber is sealed so air can only exit the cyclone bodies 54 through the vortex finders 62 located at the top of each of the cyclone bodies 54. Partially cleaned air arriving from the first cyclone stage 32, shown as arrows T, enters a first plenum 64 in the second cyclone stage 34. This first plenum 64 extends from the outlet of the first cyclone stage 32 to the inlets 60 of all of the cyclone bodies 54 in the second cyclone stage 34, regardless of which level the cyclone bodies are on. Therefore the first plenum 64 acts as a common feed to all cyclone bodies 54 in the cyclonic separator 28. As indicated by the arrows U, air is able to pass around the cyclone bodies 54 of the lower layer L within the first plenum 64. As such, air located at any point within the first plenum 64 can potentially be drawn into any one of the cyclone bodies 54 within the second cyclone stage 34.

Arrows V show the airflow pathway within the first plenum at the level containing the inlets for the lower layer L. Some of the air is drawn into the inlets 60 of the lower layer cyclone bodies $C_{1L}$, $C_{2L}$, $C_{3L}$, $C_{4L}$, $C_{5L}$ and $C_{6L}$, while the remainder of the air continues to progress up the first plenum towards the inlets of the cyclones in the upper layer U.

The air that does not enter the cyclone bodies of the lower level L is drawn into the inlets 60 of the upper layer cyclones $C_{1U}$, $C_{2U}$, $C_{3U}$, $C_{4U}$, $C_{5U}$ and $C_{6U}$. As air is drawn into the cyclone bodies 54, more air continues to be drawn into the first plenum 64 from the first cyclone stage 32 to replace it.

As air passes through a cyclone body 54, it spirals around and any dust that is entrained in the air is separated by centrifugal forces which cause the dust particles to be thrown from the air. The dust then passes through an opening in the bottom of the cyclone body 54 from which it is deposited into a second dust collection chamber, whereas the air passes back up the cyclone body towards the vortex finder 62.

Once the air has passed through the vortex finders 62, it then enters a second plenum 66. The second plenum 66 is separate from the first plenum 64, but is also common to all of the cyclone bodies 54 of the second cyclone stage 34. The second plenum 66 extends from the outlet of each of the cyclone bodies 54 to an inlet of a further stage in the cyclonic separator 28. In the present embodiment, the further stage is a filter stage. However, the further stage could equally be a further cyclone stage, or a chamber having an outlet of the cyclonic separator. The second plenum 66 therefore acts as a common volume into which the air from all of the cyclone bodies 54 is unloaded. The arrows X and Y show air exiting the vortex finders of the lower layer L and upper layer U cyclone bodies respectively and entering the second plenum 66.

In order that the two plenums can more easily be distinguished, the schematic representation of FIG. 5 is repeated in FIGS. 6*a* and 6*b*. In FIG. 6*a* the first plenum 64 has been highlighted using a first hatch pattern, and in FIG. 6*b* the second plenum 66 has been highlighted using a second hatch pattern. These two hatch patterns are used uniformly throughout the figures to indicate the location of the first and second plenums 64,66.

While passing through the second cyclone stage 34, the air is not required or restricted to pass through any conduits or ducts. The air feeding into all the cyclone bodies comes from a single common volume, and this ensures that each of the cyclone bodies has an equal load of air supply passing through it. Although the representations of FIGS. 5, 6*a* and 6*b* contain arrows that suggest the air takes specific pathways through the second cyclone stage 34, it should be understood that the arrows merely indicate examples of the general airflow, and that, in practice, air within the first and second plenums is not restricted to following any particular pathway.

As can be seen in the figures, the inlet 60 and outlet 62 for each cyclone body 54 is the same as for all other cyclone bodies 54. In other words, the sizes and dimensions of all inlets 60 are the same. In addition, the sizes and dimensions of all outlets 62 are the same. Consequently, there is no preferential loading of air supply on any of the cyclone bodies 54.

Figure 7:
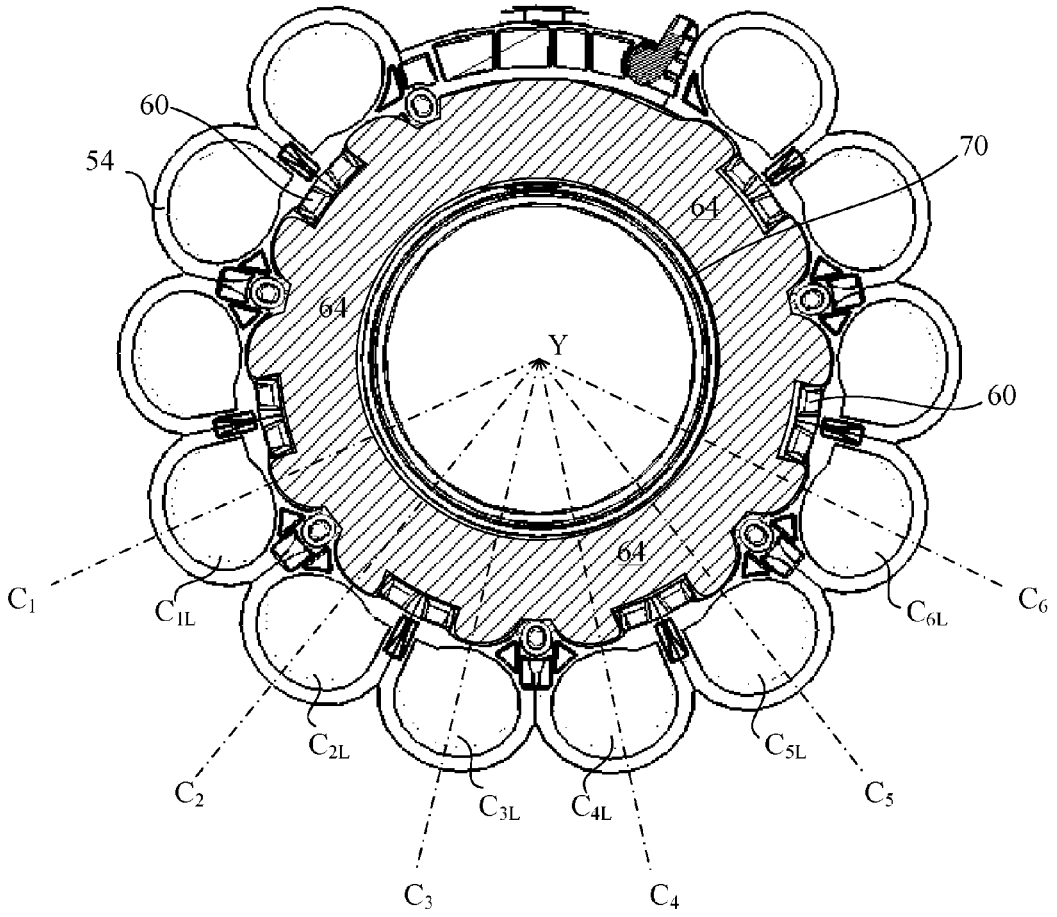
FIG. 7 is a cross section through the cyclonic separator of FIG. 3 along the line A-A.

FIG. 7 shows a cross section through the cyclonic separator 28 of FIG. 3 which passes through the lower layer L of cyclone bodies 54, denoted by dotted line A-A in FIG. 3. The first plenum 64 forms a ring between the cyclone bodies 54 and an inner wall 70. The inner wall defines a chamber that houses a filter through which air is passed after leaving the second cyclone stage 34. Inlets 60 of the cyclone bodies 54 are open to the first plenum 64 such that they are able to draw air into the cyclone bodies 54 from the first plenum 64. Each of the inlets 60 opens directly onto the first plenum, therefore no ducting or conduits are required to direct the air towards the inlets 60. No part of the second plenum 66 is visible at this level. For simplicity, the upper level U of cyclone bodies have been removed from view in this figure, but the first plenum 64 extends around the cyclone bodies of the upper level U which pass through the first plenum 64 at an angle inclined towards the longitudinal axis Y.

Figure 8A:
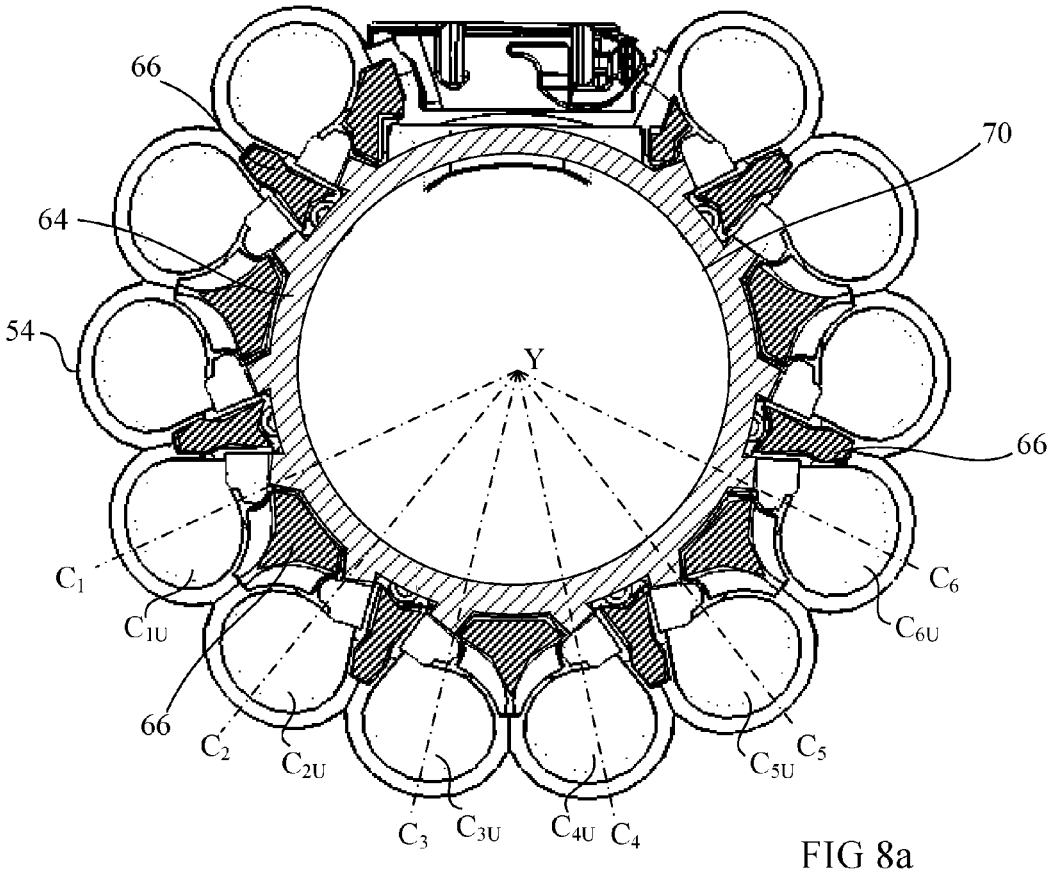
FIG. 8*a* is a second cross section through the cyclonic separator of FIG. 3 along the line B-B.
Figure 8B:
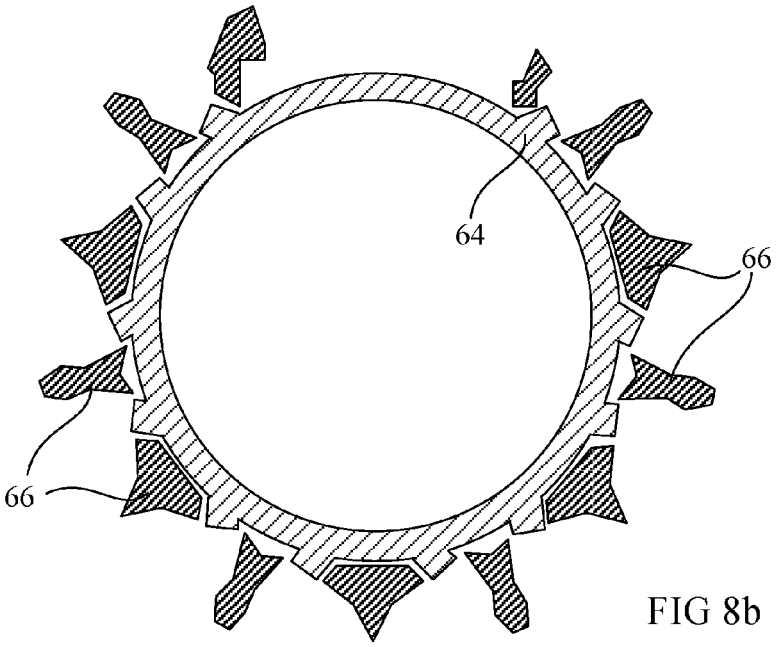
FIG. 8*b* shows a portion of FIG. 8*a;*

FIG. 8*a* shows a cross section through the cyclonic separator 28 of FIG. 3 which passes through the upper layer U of cyclone bodies 54, denoted by dotted line B-B in FIG. 3. The first plenum 64 is still visible and forms a ring around the inner wall 70. The first plenum 64 extends to the inlets 60 of each of the cyclone bodies 54 in the upper layer U. In addition, the second plenum 66 can also be seen, and is located between the cyclone bodies 54 and the first plenum 64. The second plenum appears, when viewed in cross-section at this level, to be a multiplicity of individual volumes. However, these seemingly separate volumes are all connected at other levels to form one plenum. In order to more easily view the first and second plenums 64,66 of FIG. 8*a*, they have been reproduced in FIG. 8*b* without the cyclonic separator visible. The second plenum 66 generally surrounds the first plenum 64.

Figure 9:
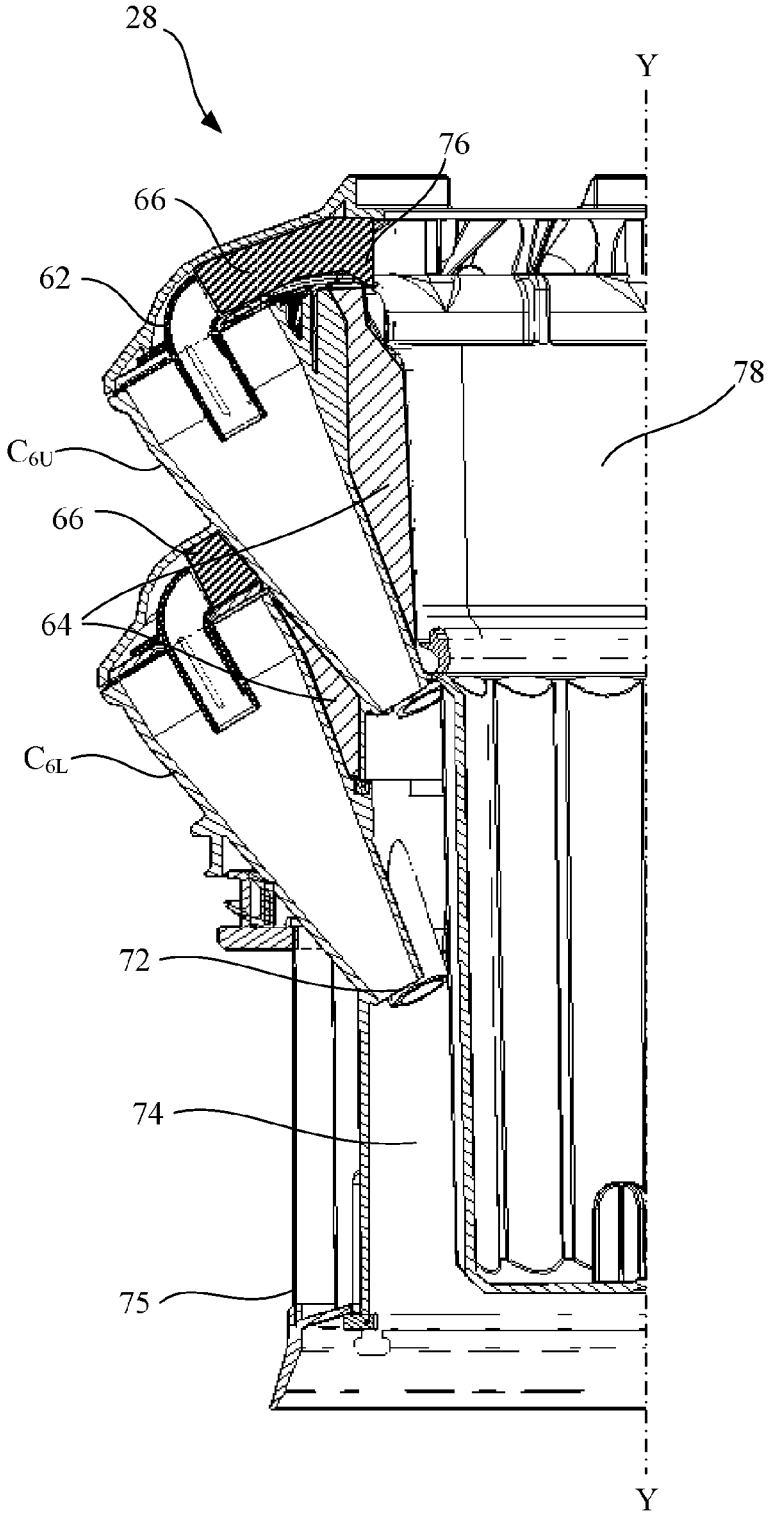
FIG. 9 is a cross section through the cyclonic separator of FIG. 4 along the line $C_6$-Y.

FIG. 9 shows a cross section through one half of the cyclonic separator along the line $C_6$-Y shown in FIG. 3. This cross-section passes directly through the cyclone bodies $C_{6U}$ and $C_{6L}$. Each of cyclone bodies $C_{6U}$ and $C_{6L}$ has an outlet in the form of a vortex finder 62. At the lower end of the cyclone bodies is an opening 72. These openings 72 are open to an annular chamber which forms part of the second dirt collection chamber 74. The dust that is separated by each of the cyclone bodies $C_{6U}$ and $C_{6L}$ is deposited through the openings 72 and will pass into the second dirt collection chamber 74. Located around the outside of the second dirt collection chamber 74 is the shroud 75. The shroud 75 has a wall having a multiplicity of through-holes, for example a mesh, and an inlet to the first plenum 64 (not visible in FIG. 9) is located behind the wall of the shroud 75. The cross section of FIG. 9 passes through the first plenum 64 in two areas on the inner side of both cyclone bodies $C_{6U}$ and $C_{6L}$. The cross section of FIG. 9 also passes through the second plenum 66 in two places: one on the outer side of the upper cyclone body $C_{6U}$ at the opening of the vortex finder of $C_{6L}$, and the other above the cyclone bodies at the opening of the vortex finder of $C_{6U}$. The second plenum 66 has an annular outlet 76 at its uppermost point that feeds air into a filter stage 78 in the cyclonic separator 28.

Figure 10:
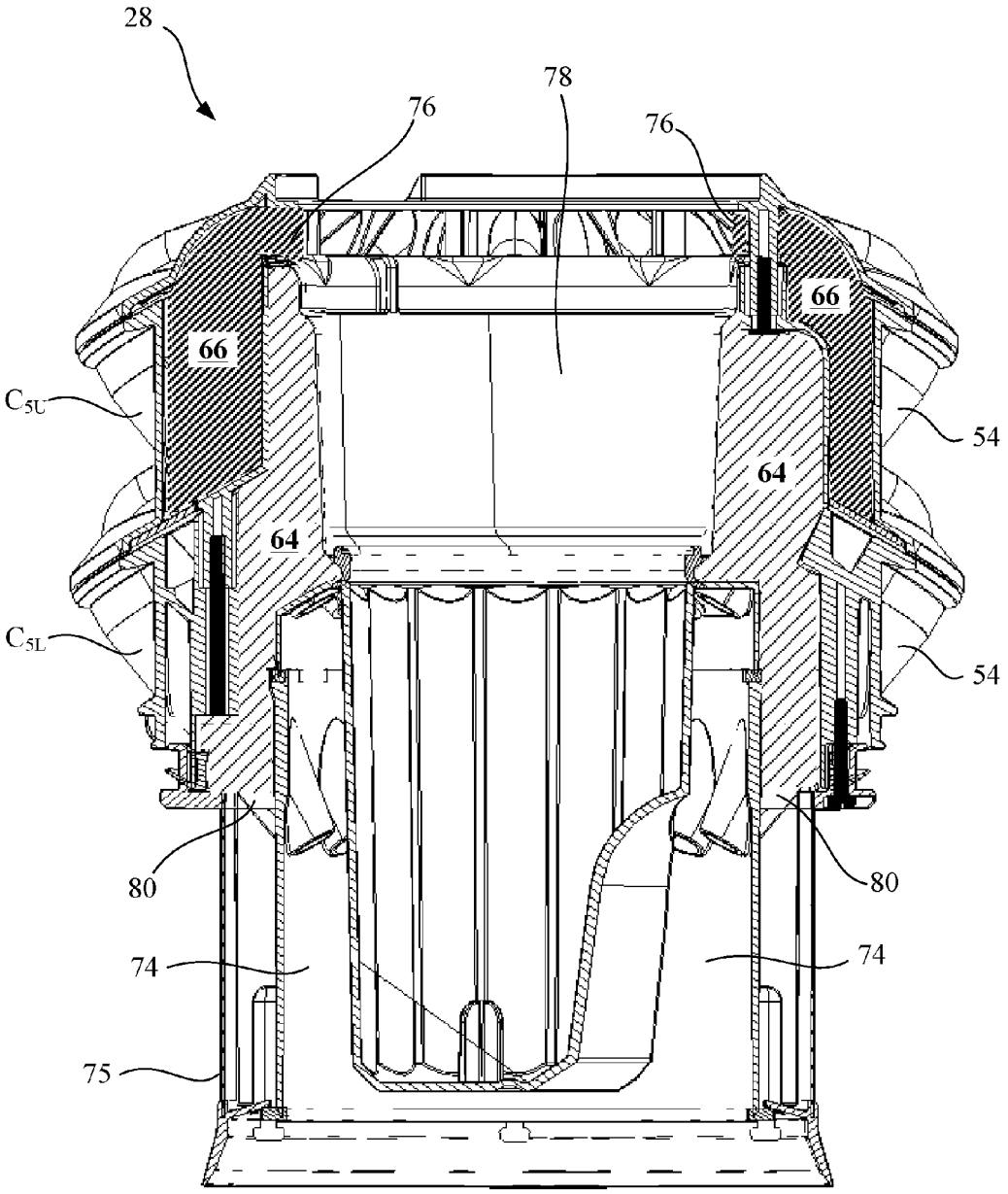
FIG. 10 is a second cross section through the cyclonic separator of FIG. 4 along the line D-D.

FIG. 10 shows a full cross section through the cyclonic separator 28 along the line D-D shown in FIG. 3. This cross-section passes between the cyclone bodies at $C_6$ and $C_5$. This cross section clearly shows the two separate plenums, with the second plenum 66 substantially surrounding the first plenum 64. The inlet 80 to the first plenum 64 is visible and is positioned behind the wall of the shroud 75 at the lowest point of the chamber that defines the first plenum 64.

Whilst particular embodiments have thus far been described, it will be understood that various modifications may be made without departing from the scope of the invention as defined by the claims.

The invention claimed is:

1. A cyclonic separator comprising a first cyclone stage; and a second cyclone stage comprising a plurality of cyclone bodies arranged in parallel, each cyclone body comprising an inlet and an outlet, the plurality of cyclone bodies being divided into at least a first layer and a second layer;

wherein the second cyclone stage further comprises a first plenum common to the cyclone bodies, the first plenum extending from an outlet of the first cyclone stage to the inlets of the cyclone bodies of the second cyclone stage, and wherein the first plenum is an open chamber.

2. The cyclonic separator of claim 1, wherein the second cyclone stage further comprises a second plenum common to the cyclone bodies and extending from the outlet of each of the cyclone bodies.

3. The cyclonic separator of claim 2, wherein the second plenum substantially surrounds the first plenum.

4. The cyclonic separator of claim 2, wherein the cyclonic separator comprises a further stage located downstream of the second cyclone stage, the second plenum extends from the outlets of the cyclone bodies to the further stage, and the further stage is one of a cyclone stage, a filter stage and a chamber comprising an outlet of the cyclonic separator.

5. The cyclonic separator of claim 2, wherein the second plenum is substantially annular.

6. The cyclonic separator of claim 1, wherein the first plenum is substantially annular.

7. The cyclonic separator of claim 1, wherein the first plenum has a substantially annular inlet.

8. The cyclonic separator of claim 1, wherein the inlets of the cyclone bodies have the same size and dimensions.

9. The cyclonic separator of claim 1, wherein the outlets of the cyclone bodies have the same size and dimensions.

10. A vacuum cleaner comprising a cyclonic separator as claimed in claim 1.

11. A cyclonic separator comprising a first cyclone stage; and a second cyclone stage comprising a plurality of cyclone bodies arranged in parallel, each cyclone body comprising an inlet and an outlet, the plurality of cyclone bodies being divided into at least a first layer and a second layer;

wherein the second cyclone stage further comprises a first plenum common to the cyclone bodies, the first plenum extending from an outlet of the first cyclone stage to the inlet of each of the cyclone bodies of the second cyclone stage, wherein the first plenum is an open chamber, wherein the second cyclone stage further comprises a second plenum common to the cyclone bodies and extending from the outlet of each of the cyclone bodies, wherein the cyclonic separator comprises a further stage located downstream of the second cyclone stage, the second plenum extends from the outlets of the cyclone bodies to the further stage, and the further stage is one of a cyclone stage, a filter stage and a chamber comprising an outlet of the cyclonic separator, and wherein the second plenum substantially surrounds the first plenum, and the first plenum substantially surrounds the further stage.

12. The cyclonic separator of claim 11, wherein each of the plenums is substantially annular.

13. The cyclonic separator of claim 11, wherein the inlets of the cyclone bodies have the same size and dimensions.

14. The cyclonic separator of claim 11, wherein the outlets of the cyclone bodies have the same size and dimensions.

15. A vacuum cleaner comprising a cyclonic separator according to claim 11.

* * * * *